US006818078B2

(12) United States Patent
Kim et al.

(10) Patent No.: US 6,818,078 B2
(45) Date of Patent: Nov. 16, 2004

(54) JOINING OF AMORPHOUS METALS TO OTHER METALS UTILZING A CAST MECHANICAL JOINT

(75) Inventors: Choongnyun Paul Kim, Northridge, CA (US); Atakan Peker, Aliso Viejo, CA (US)

(73) Assignee: Liquidmetal Technologies, Lake Forest, CA (US)

( * ) Notice: Subject to any disclaimer, the term of this patent is extended or adjusted under 35 U.S.C. 154(b) by 61 days.

(21) Appl. No.: 10/210,398

(22) Filed: Jul. 31, 2002

(65) Prior Publication Data

US 2003/0024616 A1 Feb. 6, 2003

Related U.S. Application Data

(60) Provisional application No. 60/309,767, filed on Aug. 2, 2001.

(51) Int. Cl.[7] ..... C22C 45/10

(52) U.S. Cl. ..... 148/522; 148/561; 148/403; 228/232

(58) Field of Search ..... 148/522, 561, 148/403; 228/229, 232

(56) References Cited

U.S. PATENT DOCUMENTS

| | | | |
|---|---|---|---|
| 5,288,344 | A | 2/1994 | Peker et al. |
| 5,368,659 | A | 11/1994 | Peker et al. |
| 5,482,580 | A | 1/1996 | Scruggs et al. |
| 5,618,359 | A | 4/1997 | Lin et al. |
| 5,735,975 | A | 4/1998 | Lin et al. |
| 5,797,443 | A | 8/1998 | Lin et al. |
| 6,010,580 | A | 1/2000 | Dandliker et al. |
| 6,325,868 | B1 | 12/2001 | Kim et al. |

FOREIGN PATENT DOCUMENTS

| | | |
|---|---|---|
| JP | 2001303218 | 10/2001 |

OTHER PUBLICATIONS

Hays et al., "Microstructure Controlled Shear Band Pattern Formation and Enhanced Plasticity of Bulk Metallic Glasses Containing in Situ Formed Ductile Phase Dendrite Dispersions," *Physical Review Letters*, Mar. 27, 2000, pp. 2901–2904, vol. 84, No. 13, The American Physical Society.

Inoue et al., "Bulk Amorphous Alloys with High Mechanical Strength and Good Soft Magnetic Properties in Fe–TM–B (TM=IV–VIII Group Transition Metal) System," *App. Phys. Lett.*, Jul. 28, 1997, pp. 464–466, vol. 71, No. 4, American Institute of Physics.

Shen et al., "Bulk Glassy $Co_{43}Fe_{20}Ta_{5.5}B_{31.5}$ Alloy with High Glass–Forming Ability and Good Soft Magnetic Properties," *Materials Transactions*, 2001, pp. 2136–2139, vol. 42, No. 10, Rapid Publication.

*Primary Examiner*—George Wyszomierski
(74) *Attorney, Agent, or Firm*—Christie, Parker & Hale, LLP

(57) ABSTRACT

The present invention is directed to a method of joining an amorphous material to a non-amorphous material including, forming a cast mechanical joint between the bulk solidifying amorphous alloy and the non-amorphous material.

17 Claims, 6 Drawing Sheets

JOINING OF AMORPHOUS METALS TO OTHER METALS UTILZING A CAST MECHANICAL JOINT

CROSS-REFERENCE TO RELATED APPLICATION

This application claims priority on U.S. provisional application No. 60/309,767 filed on Aug. 2, 2001, the content of which is incorporated herein by reference.

FIELD OF THE INVENTION

The present invention is related to methods for joining bulk solidifying amorphous alloys with non-amorphous metals.

BACKGROUND OF THE INVENTION

Bulk solidifying amorphous alloys are a family of amorphous alloys which can be cooled from the molten state at substantially lower cooling rates, about 500 K/sec or less, than older conventional amorphous alloys and still substantially retain their amorphous atomic structure. As such, they may be produced in amorphous form and with thicknesses of 1 millimeter or more, significantly thicker than possible with the older amorphous alloys that require much higher cooling rates. Bulk-solidifying amorphous alloys have been described, for example, in U.S. Pat. Nos. 5,288,344; 5,368,659; 5,618,359; and 5,735,975, the disclosures of which are incorporated by reference.

A family of bulk-solidifying alloys of most interest may be described by the molecular equation: $(Zr,Ti)_a(Ni,Cu,Fe)_b(Be,Al,Si,B)_c$, where a is in the range of from about 30 to about 75, b is in the range of from about 5 to about 60, and c is in the range of from 0 to about 50, in atomic percentages. These alloys can accommodate substantial amounts of other transition metals, up to about 20 atomic percent, and preferably metals such as Nb, Cr, V, and Co. A preferred alloy family is $(Zr,Ti)_d(Ni,Cu)_e(Be)_f$, where d is in the range of from about 40 to about 75, e is in the range of from about 5 to about 60, and f is in the range of from about 5 to about 50, in atomic percentages. Still a more preferably composition is $Zr_{41}Ti_{14}Ni_{10}Cu_{12.5}Be_{22.5}$, in atomic percentages. Bulk solidifying amorphous alloys are desireable because they can sustain strains up to about 1.5 percent or more without any permanent deformation or breakage; they have high fracture toughness of about 10 ksi sqrt(in) or more (sqrt denotes square root), and preferably 20 ksi sqrt(in) or more; and they have high hardness values of 4 GPa or more, and preferably 5.5 GPa or more. In addition to desirable mechanical properties, bulk solidifying amorphous alloys also have very good corrosion resistance.

Because the properties of the bulk solidifying amorphous alloys may not be needed for some parts of the structure, and because they are relatively expensive compared to non-amorphous materials, such as aluminum alloys, magnesium alloys, steels, and titanium alloys many cases, bulk solidifying amorphous alloys are typically not used to produce an entire structure. It is therefore necessary to join is the bulk solidifying amorphous alloy portion of the structure to the portion of the structure that is the non-amorphous solidifying alloy.

A number of different joining methods have been explored including: mechanical fasteners, which may be used in some cases, but they have disadvantages in both mechanical properties and physical properties, such as corrosion resistance, when in contact with the bulk solidifying amorphous alloy; adhesives, which may be used, but only if the service temperature is sufficiently low that the adhesive retains its strength; and finally, brazing and welding, which are possibilities, but satisfactory techniques and materials have not been developed for the brazing and welding of amorphous materials.

Accordingly, a need exists for a method of joining amorphous materials to non-amorphous materials in an inexpensive, but robust manner.

SUMMARY OF THE INVENTION

The present invention is directed to a method of joining a bulk-solidifying amorphous material to a non-amorphous material including, forming a cast mechanical joint between the bulk solidifying amorphous alloy and the non-amorphous material.

In a first embodiment, the joint is formed by controlling the melting point of the non-amorphous and bulk-solidifying amorphous alloys (amorphous metals). In one such embodiment, where the non-amorphous metal has a higher melting point than the melting point of the amorphous metal, the non-amorphous metal is properly shaped and the bulk-solidifying amorphous alloy is melted and cast against the piece of preformed non-amorphous metal by a technique such as injection or die casting. In another such embodiment, where the non-amorphous metal has a lower melting point than the melting point of the amorphous metal, the non-amorphous material may be joined to the bulk-solidifying amorphous alloy by melting the non-amorphous alloy and casting it, as by injection or die casting, against a piece of the properly shaped and configured bulk-solidifying amorphous alloy which remains solid.

In a second embodiment, the joint is formed by controlling the cooling rate of the non-amorphous and amorphous metals. In one such embodiment, a non-amorphous metal is cast against a piece of pre-formed bulk-solidifying amorphous alloy, and cooled from the casting temperature of the non-amorphous alloy down to below the glass transition temperature of bulk-solidifying amorphous alloy at rates at least about the critical cooling rate of bulk solidifying amorphous alloy.

In either of the above embodiments, a system, such as a heat sink may be provided to ensure that the temperature of either the pre-formed amorphous metal or pre-formed non-amorphous metal always stay below the glass transition temperature of the bulk-solidifying amorphous alloy.

In still another embodiment, the shapes of the pieces of the bulk-solidifying amorphous alloy and the non-amorphous metal are selected to produce mechanical interlocking of the final pieces.

BRIEF DESCRIPTION OF THE DRAWINGS

These and other features and advantages of the invention will be apparent from the following detailed description, appended claims, and accompanying drawings, in which:

DETAILED DESCRIPTION OF THE INVENTION

Figure 1:
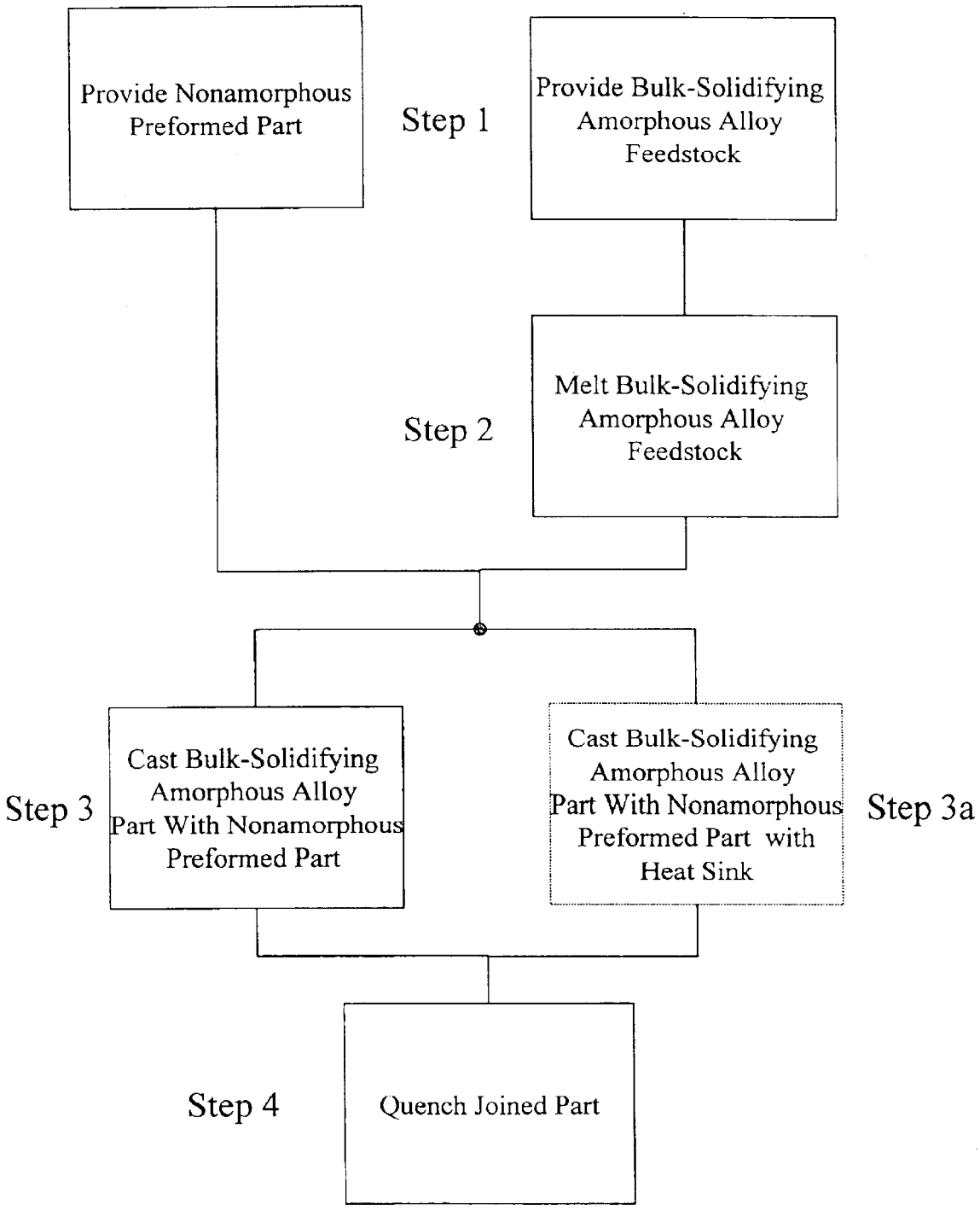
FIG. 1 is a flow chart of a method according to a first exemplary embodiment of the current invention.

The present invention is directed to a method of joining a bulk-solidifying amorphous alloy to a non-amorphous metal.

The bulk solidifying amorphous alloys are a family of amorphous alloys which can be cooled from the molten state at substantially lower cooling rates, about 500 K/sec or less, than older conventional amorphous alloys and still substantially retain their amorphous atomic structure. As such, they may be produced in amorphous form and with thicknesses of 1 millimeter or more, significantly thicker than possible with the older amorphous alloys that require much higher cooling rates. Bulk solidifying amorphous alloys have been described, for example, in U.S. Pat. Nos. 5,288,344; 5,368,659; 5,618,359; and 5,735,975, the disclosures of which are incorporated by reference.

A family of bulk-solidifying alloys of most interest may be described by the molecular equation: $(Zr,Ti)_a(Ni,Cu,Fe)_b(Be,Al,Si,B)_c$, where a is in the range of from about 30 to about 75, b is in the range of from about 5 to about 60, and c is in the range of from 0 to about 50, in atomic percentages. These alloys can accommodate substantial amounts of other transition metals, up to about 20 atomic percent, and preferably metals such as Nb, Cr, V, and Co. A preferred alloy family is $(Zr, Ti)_d(Ni,Cu)_e(Be)_f$, where d is in the range of from about 40 to about 75, e is in the range of from about 5 to about 60, and f is in the range of from about 5 to about 50, in atomic percentages. Still a more preferably composition is $Zr_{41}Ti_{14}Ni_{10}Cu_{12.5}Be_{22.5}$, in atomic percentages. Another preferable alloy family is $(Zr)_a$ $(Nb,Ti)_b(Ni,Cu)_c(Al)_d$, where a is in the range of from 45 to 65, b is in the range of from 0 to 10, c is in the range of from 20 to 40 and d in the range of from 7.5 to 15 in atomic percentages. Bulk solidifying amorphous alloys can sustain strains up to about 1.5 percent or more without any permanent deformation or breakage. They have high fracture toughness of about 10 ksi-sqrt(in) or more (sqrt denotes square root), and preferably 20 ksi sqrt(in) or more. Also, they have high hardness values of 4 GPa or more, and preferably 5.5 GPa or more. In addition to desirable mechanical properties, bulk solidifying amorphous alloys also have very good corrosion resistance.

Another set of bulk-solidifying amorphous alloys are compositions based on ferrous metals (Fe, Ni, Co). Examples of such compositions are disclosed in U.S. Pat. No. 6,325,868; (A. Inoue et. al., Appl. Phys. Lett., Volume 71, p 464 (1997)); (Shen et. al., Mater. Trans., JIM, Volume 42, p 2136 (2001)); and Japanese patent application 2000126277 (Publ. #.2001303218 A), all of which are incorporated herein by reference. One exemplary composition of such alloys is $Fe_{72}Al_5Ga_2P_{11}C_6B_4$. Another exemplary composition of such alloys is $Fe_{72}Al_7Zr_{10}Mo_5W_2B_{15}$. Although, these alloy compositions are not processable to the degree of the Zr-base alloy systems, they can be still be processed in thicknesses around 1.0 mm or more, sufficient enough to be utilized in the current invention.

In general, crystalline precipitates in bulk-solidifying amorphous alloys are highly detrimental to the alloys' properties, especially to the toughness and strength of such alloys, and, as such, it is generally preferred to minimize the volume fraction of these precipitates as much as possible. However, there are cases in which ductile crystalline phases precipitate in-situ during the processing of bulk-solidifying amorphous alloys that are indeed beneficial to the properties of bulk-solidifying amorphous alloys, and especially to the toughness and ductility. Such bulk-solidifying amorphous alloys comprising such beneficial precipitates are also included in the current invention. One exemplary case is disclosed in (C. C. Hays et. al, Physical Review Letters, Vol. 84, p 2901, 2000), the disclosure of which is incorporated herein by reference.

The second metal, which is generally termed herein the "non-amorphous" metal because it is normally non-amorphous in both that it has a different composition and that it is a conventional crystalline metal in the case of a metal, may be chosen from any suitable non-amorphous metals including, for example, aluminum alloys, magnesium alloys, steels, nickel-base alloys, copper alloys and titanium-base alloys, etc.

Figure 2:
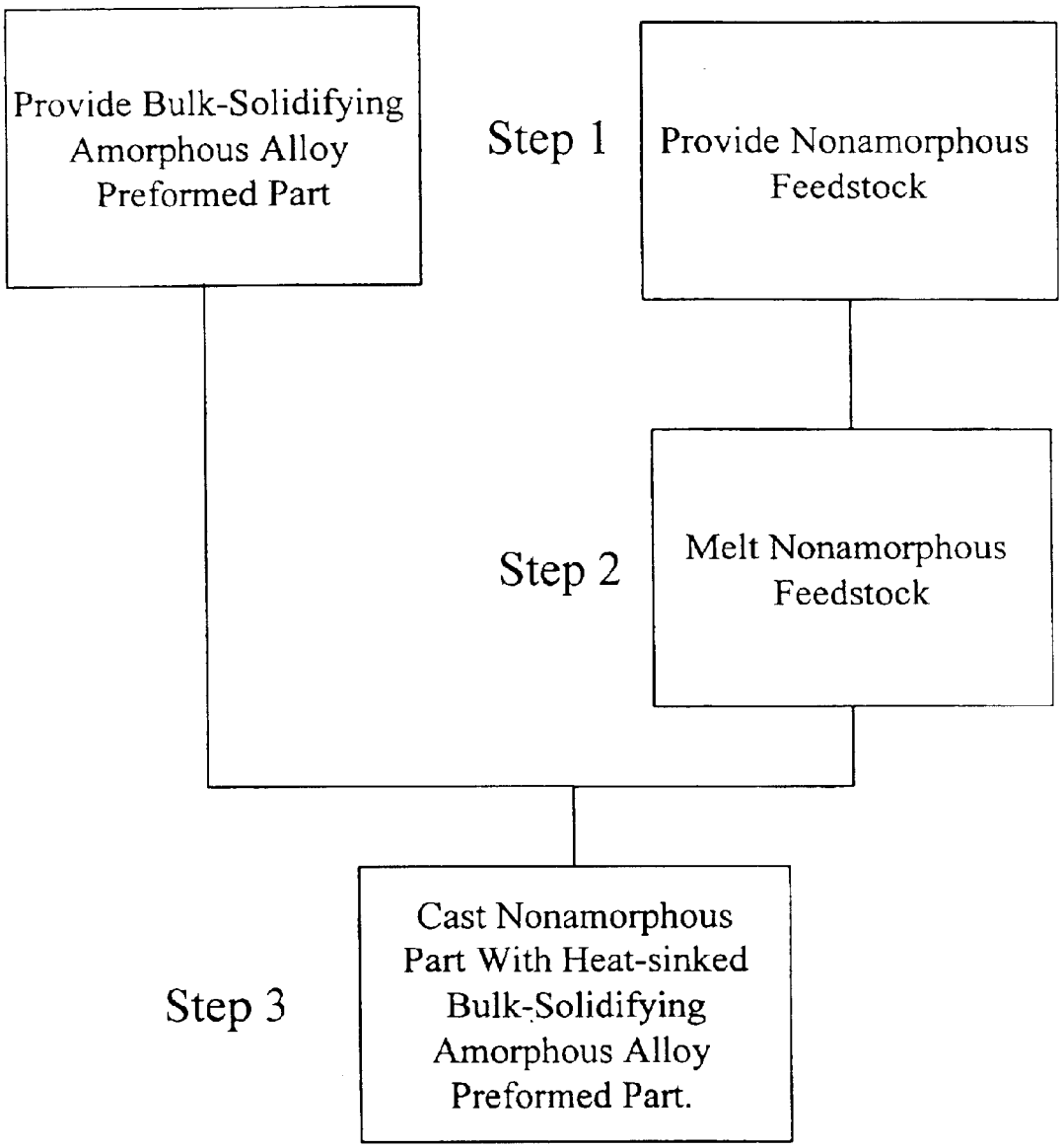
FIG. 2 is a flow chart of a method according to a second exemplary embodiment of the current invention.

The invention is first directed to a method of joining the bulk-amorphous alloy to the non-amorphous metal. As shown in FIGS. 1 and 2, there are two different methods depending on the relative physical properties of the metals.

In the first exemplary embodiment, as shown in FIG. 1, a method is provided for joining a non-amorphous metal, which has a higher melting point, to a bulk-solidifying amorphous alloy that has a lower relative melting point. Although amorphous materials do not experience a melting phenomenon in the same manner as a crystalline material, it is convenient to describe a "melting point" at which the viscosity of the material is so low that, to the observer, it behaves as a melted solid. The melting point or melting temperature of the amorphous metal may be considered as the temperature at which the viscosity of the material falls below about 102 poise. Alternatively, it can be convenient to take the melting temperature of the crystalline phases of the bulk-solidifying amorphous alloy composition as the melting temperature of the amorphous metal.

For example, the melting points of steels, nickel-base alloys, and most titanium-base alloys are greater than the melting point of most bulk solidifying amorphous alloys. In this case, the non-amorphous metal is properly shaped and configured and remains a solid (step 1), and the bulk-solidifying amorphous metal is melted (step 2) and cast (step 3) against the piece of the pre-formed non-amorphous metal by a technique such as injection or die casting. Where the bulk-solidifying amorphous alloy is the metal that is melted, it must also be cooled (step 4) sufficiently rapidly to achieve the amorphous state at the completion of the processing, but such cooling is within the range achievable in such casting techniques. The rapid cooling may be achieved by any operable approach. In one example, the rapid cooling of the melted bulk-solidifying amorphous alloy when it contacts the non-amorphous metal and the mold is sufficient. In other cases, the entire mold with the enclosed metals may be rapidly cooled following casting.

In a further preferred alternative embodiment, as shown in the dashed box (optional step **3*a***), a further heat sink, or like temperature maintenance system, is provided to the non-amorphous metal preformed part to ensure that the part does not exceed the glass transition temperature ($T_g$) of the bulk-solidifying amorphous alloy piece such that the stored heat in the non-amorphous part does not cause the amorphous alloy to flow or crystallize during or after the casting process. The heat sink can be a passive one, such as the case where the preformed non-amorphous metal part is massive enough to be the heat sink itself. Alternatively, the heat sink can be an active (or external) one, such as mold or die walls with intimate or close contact with the pre-formed non-amorphous metal part. Finally, the heat sink can be achieved by actively cooling a piece of the bulk-solidifying amorphous alloy casting (which is in intimate or close contact with the pre-formed non-amorphous metal part). This active cooling can also be achieved through mold or die walls.

In the second exemplary method, depicted in a flow-chart in FIG. 2, the non-amorphous metal has a lower melting point than the melting point of the amorphous metal.

In one example, a bulk-solidifying amorphous alloy as described above, is joined to a low-melting point non-amorphous metal, such as an aluminum alloy. The melting point of a typical amorphous metal, as described above, is on the order of 800° C. The melting point of most aluminum alloys is about 650° C. or less. In such an exemplary embodiment, a piece of the aluminum alloy (or other lower-melting-point alloy, such as a magnesium alloy) may be joined to a piece of the bulk-solidifying amorphous alloy (step 1) by melting the aluminum alloy (step 2) and casting it, as by injection or die casting, against a piece of the properly shaped and configured bulk-solidifying amorphous alloy which remains solid (step 3) as shown in FIG. 2.

In this embodiment of the invention, to ensure that the bulk-solidifying amorphous alloy remains solid, a heat sink is provided which keeps the bulk-solidifying amorphous alloy at a temperature below the transition glass temperature ($T_g$) of the bulk-solidifying amorphous alloy. The heat sink can be a passive one, such as in the case where the preformed bulk-solidifying amorphous alloy part is massive enough to be the heat sink itself. Alternatively, the heat sink can also be an active (or external) one, such as the mold or die walls in intimate or close contact with the piece of preformed bulk-solidifying amorphous alloy. Finally, the heat sink can also be achieved by actively cooling the casting of the non-amorphous metal (which is in intimate or close contact with the piece of pre-formed bulk-solidifying amorphous alloy). This cooling can also be achieved through mold or die walls.

Although the above embodiments depend on the physical properties, i.e., melting temperatures of the amorphous and non-amorphous metals, it should be understood that by controlling the cooling rate of the molten or cast metals that such limitations are not required. Specifically, by controlling the cooling rate of the cast metals to prevent crystallization of the amorphous metal either of the metals, regardless of their relative melting temperatures, could be utilized as the "cast metal".

Figure 3:
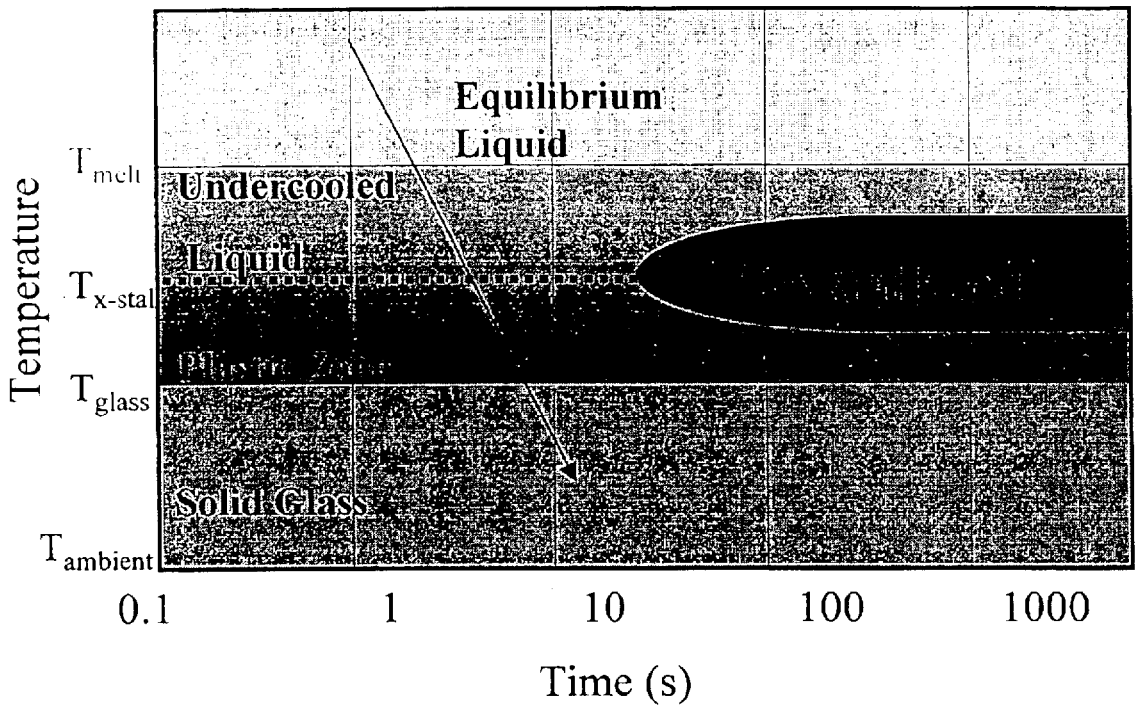
FIG. 3 is a schematic Time-Temperature-Transformation ("TTT") diagram of an amorphous metal according to the invention.

The crystallization behavior of bulk-solidifying amorphous alloys when it is undercooled from a molten liquid to below its equilibrium melting point $T_{melt}$ can be graphical illustrated using Time-Temperature-Transformation ("TTT") diagrams, an illustrative TTT-diagram is shown in FIG. 3. It is well known that if the temperature of an amorphous metal is dropped below the melting temperature the alloy will ultimately crystallize if not quenched to the glass transition temperature before the elapsed time exceeds a critical value, $t_x(T)$. This critical value is given by the TTT-diagram and depends on the undercooled temperature. Accordingly, the bulk-solidifying amorphous alloy must be initially cooled sufficiently rapidly from above the melting point to below the glass transition temperature ($T_g$) sufficiently fast to bypass the "nose region" of the material's TTT-diagram ($T_{nose}$, which represents the temperature for which the minimum time to crystallization of the alloy will occur) and avoid crystallization (as shown by the arrow in FIG. 3).

Figure 4:
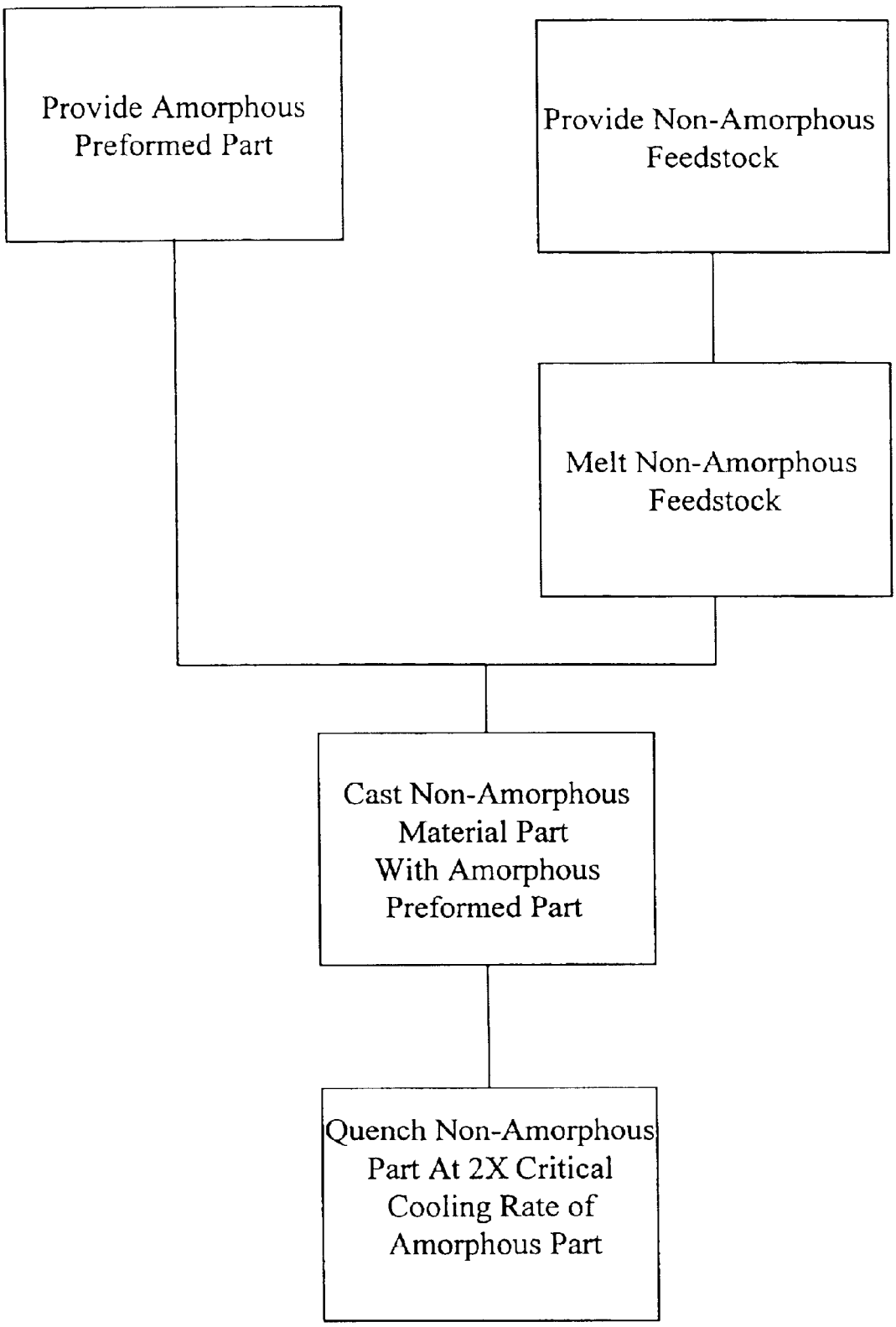
FIG. 4 is a flow chart of a method according to a third exemplary embodiment of the current invention.

In one exemplary embodiment of such a process, summarized in the flow chart shown in FIG. 4, a non-amorphous metal is cast against a piece of pre-formed bulk-solidifying amorphous alloy. In this embodiment, the non-amorphous metal is cooled from the casting temperature of the non-amorphous metal down to below the glass transition temperature of the bulk-solidifying amorphous alloy at rates higher than the critical cooling rate of the bulk solidifying amorphous alloy. By controlling the cooling rate of the non-amorphous metal being cast, the preformed bulk amorphous metal piece remains in the left portion of its TTT diagram, in the non-crystallization region (FIG. 3). In such an embodiment, preferably, the non-amorphous metal is cooled from the casting temperature of non-amorphous metal down to below the glass transition temperature of the bulk-solidifying amorphous alloy at rates higher than twice the critical cooling rate of bulk solidifying amorphous alloy to ensure that no portion of the amorphous metal piece is crystallized.

Several casting methods can be implemented to provide the sufficient cooling rate. For example, metallic mold casting, die-casting (especially for aluminum, zinc, magnesium alloys), etc. Although this method can be performed independent of the melting temperatures of the two metals, it is preferable if the bulk solidifying amorphous alloy has a higher melting temperature than the non-amorphous metal. Controlling for both cooling rate and melting temperature ensures that the temperature of the bulk amorphous alloy always remains below its melting temperature during casting so that the viscosity and activity of the bulk amorphous alloy is kept at reduced levels, which in turn prevents unwanted intermetallics from forming at the interface of the two materials from metallurgical reactions.

Figure 5:
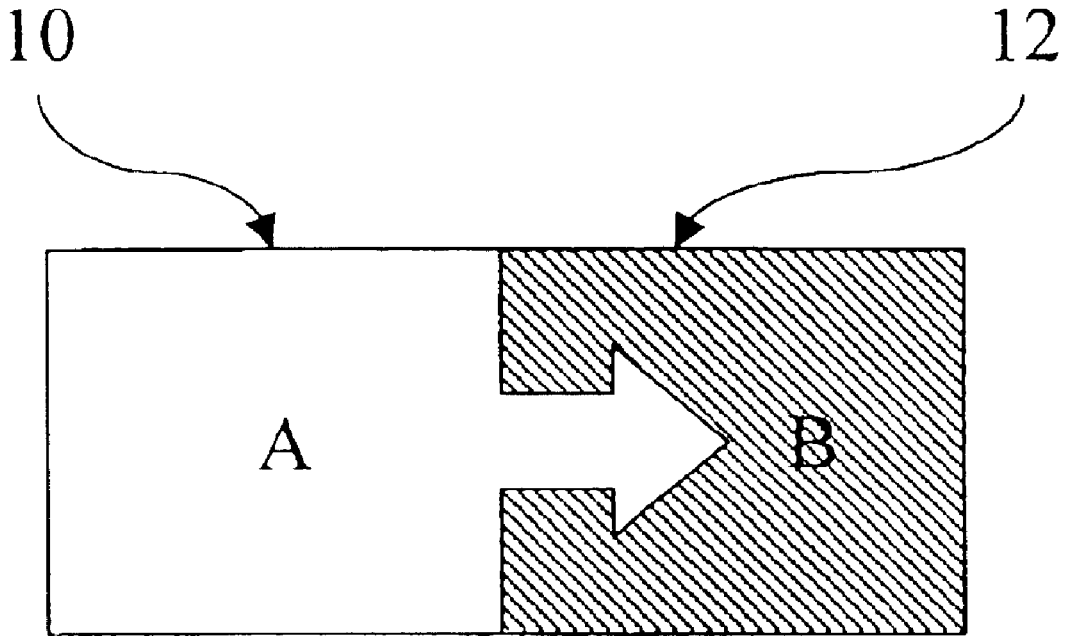
FIG. 5 is a schematic of an exemplary joint according to the present invention.
Figure 6:
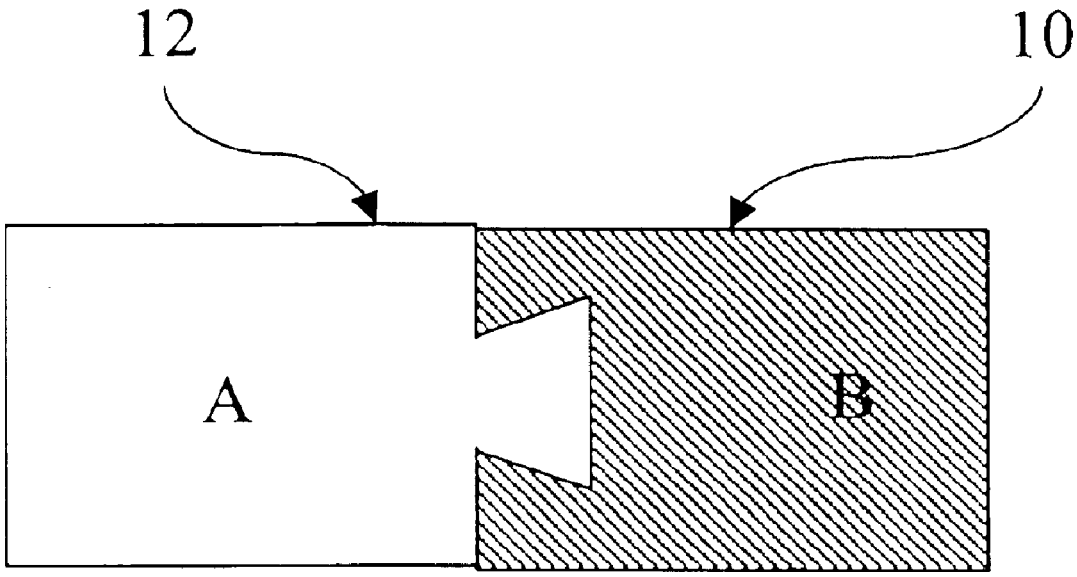
FIG. 6 is a schematic of an exemplary joint according to the present invention.

This invention is also directed to articles formed by the joining methods discussed above. In one exemplary embodiment, the shapes of the pieces of the bulk-solidifying amorphous alloy and the non-amorphous metal are selected to produce mechanical interlocking of the final pieces. FIGS. 5 and 6 illustrate such an approach. In FIGS. 5 and 6, metal A is the non-amorphous metal, and metal B is the bulk-solidifying amorphous alloy.

Referring to FIG. 5, it can be seen that if metal A has a lower melting point than metal B (first case above), metal B is machined to have an interlocking shape 10. Metal A is then melted and cast against metal B, filling and conforming to the interlocking shape 10. Upon cooling metal A solidifies into interlocking shape 12 and the two pieces 10 and 12 are mechanically locked together.

Alternatively, as shown in FIG. 6 if the non-amorphous metal A has a higher melting point than the bulk-solidifying amorphous alloy metal B (second case above), the metal A is machined to have the interlocking shape 10. Metal B is then melted and cast against metal A, filling and conforming to the interlocking shape 10. Upon cooling metal B solidifies to form interlocking shape 12 and the two pieces metal A and metal B are mechanically locked together.

Although only two different interlocking shapes are shown in FIGS. 5 and 6, it should be understood that any suitable interlocking shape may be utilized in the current invention such that there is a mechanical interference that prevents the separation of metal A and metal B, after the casting process is complete.

Although the method of the current invention is designed such that the metals are permanently mechanically locked together, such pieces be separated by melting the metal having the lower melting point to said melting point.

In addition, although the joining of only two separate pieces is discussed in the current invention, it should be understood that the method of the current invention may be utilized to join an arbitrary number of bulk-solidifying alloy and non-amorphous metal articles together.

Although specific embodiments are disclosed herein, it is expected that persons skilled in the art can and will design alternative methods to join bulk-solidifying amorphous alloys to non-amorphous metals that are within the scope of the following description either literally or under the Doctrine of Equivalents.

What is claimed is:

1. A method of joining a bulk-solidifying amorphous alloy material to a non-amorphous metal material wherein the melting temperature of the bulk-solidifying amorphous alloy material is higher than the melting temperature of the non-amorphous material, comprising:

providing a pre-formed piece, wherein the pre-formed piece is made of the bulk-solidifying amorphous alloy material;

casting a second piece at a casting temperature in a joining relationship with said pre-formed piece to form a single integral article, wherein the second piece is made of the non-amorphous metal material, and wherein the casting temperature is greater than the melting temperature of the non-amorphous metal material; and cooling the single integral article at a rate sufficient to ensure that the bulk-solidifying amorphous alloy material remains substantially amorphous.

2. The method as described in claim 1, wherein a heat sink is further provided to maintain the temperature of the preformed piece below the glass transition temperature of the bulk-solidifying amorphous alloy.

3. A method of joining a bulk-solidifying amorphous alloy material to a non-amorphous metal material, comprising:

providing a pre-farmed piece, wherein the pre-formed piece is made of a bulk-solidifying amorphous alloy material;

casting a second piece from a non-amorphous material at a casting temperature above the melting temperature of the non-amorphous material in a joining relationship with said pro-formed piece; and cooling the second piece at a rate at least about the critical cooling rate of the bulk-solidifying amorphous alloy material to form a single integral article.

4. The method as described in claim 3 wherein the bulk-solidifying amorphous alloy material is described by the equation:

$$(Zr,Ti)_a(Ni,Cu,Fe)_b(Be,Al,Si,B)_c$$

where a is in the range of from about 30 to about 75, b is in the range of from about 5 to about 60, and c is in the range of from 0 to about 50, in atomic percentages.

5. The method as described in claim 4, wherein the bulk-solidifying amorphous alloy material includes up to about 20 atomic percent of at least one additional transition metal.

6. The method as described in claim 3, wherein the bulk-solidifying amorphous alloy material is described by the equation:

$$(Zr, Ti)_d(Ni, Cu)_e(Be)_f$$

where d is in the range of from about 40 to about 75, e is in the range of from about 5 to about 60, and f is in the range of from about 5 to about 50, in atomic percentages.

7. The method as described in claim 3, wherein the bulk-solidifying amorphous alloy material is described by the equation:

$$(Zr)_a\ (Nb,Ti)_b\ (Ni,Cu)_c(Al)_d,$$

where a is in the range of from 45 to 65, b is in the range of from 0 to 10, c is in the range of from 20 to 40 and d in the range of from 7.5 to 15 in atomic percentages.

8. The method as described in claim 3, wherein the non-amorphous material is selected from the group consisting at aluminum alloys, magnesium alloys, and copper alloys.

9. The method as described in claim 3, wherein the non-amorphous material is selected from the group consisting of: steels, nickel alloys, titanium alloys, and copper alloys.

10. The method as described in claim 3, wherein the pre-formed and second pieces are designed to mechanical interlock in the single integral article.

11. The method as described in claim 3, wherein the preformed piece is cooled at a rate at least about twice the critical cooling rate of the bulk-solidifying amorphous alloy material.

12. The method as described in claim 3, wherein the step of cooling includes actively quenching both the preformed and second pieces.

13. The method as described in claim 3, wherein the rate of cooling is about 500 K/sec or less.

14. The method as described in claim 3, wherein the step of casting is selected from the group consisting of: injection casting, die casting, and mold casting.

15. The method as described in claim 3, wherein the melting temperature of the material being cast is less than the melting temperature of the material in the preformed piece.

16. An article made in accordance with the method described in claim 3.

17. The article as described in claim 16, wherein the preformed and second pieces mechanically interlock to form a single integral piece.

* * * * *